US011440035B2

(12) United States Patent
Fritz et al.

(10) Patent No.: US 11,440,035 B2
(45) Date of Patent: Sep. 13, 2022

(54) APPLICATION DEVICE AND METHOD FOR APPLYING A MULTICOMPONENT COATING MEDIUM

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Moritz Bubek, Ludwigsburg (DE); Timo Beyl, Besigheim (DE); Frank Herre, Oberriexingen (DE); Steffen Sotzny, Oberstenfeld (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 0 days.

(21) Appl. No.: 16/468,701

(22) PCT Filed: Dec. 1, 2017

(86) PCT No.: PCT/EP2017/081123
§ 371 (c)(1),
(2) Date: Jun. 12, 2019

(87) PCT Pub. No.: WO2018/108573
PCT Pub. Date: Jun. 21, 2018

(65) Prior Publication Data

US 2019/0299231 A1 Oct. 3, 2019

(30) Foreign Application Priority Data

Dec. 14, 2016 (DE) ..... 10 2016 014 919.1

(51) Int. Cl.
*B05B 7/08* (2006.01)
*B05B 15/55* (2018.01)
(Continued)

(52) U.S. Cl.
CPC ..... *B05B 7/0846* (2013.01); *B05B 7/061* (2013.01); *B05B 12/04* (2013.01); *B05B 13/02* (2013.01);
(Continued)

(58) Field of Classification Search
None
See application file for complete search history.

(56) References Cited

U.S. PATENT DOCUMENTS 3,421,694 A 1/1969 Muller
3,717,306 A * 2/1973 Hushon ..... B05B 7/0408 239/404
(Continued)

FOREIGN PATENT DOCUMENTS

CN 2287527 Y 8/1998
CN 1331661 A 1/2002
(Continued)

OTHER PUBLICATIONS

China National Intellectual Property Administration Office Action and Search Report for CN Application No. 2017800//018.3 dated Aug. 27, 2020 (11 pages; Search Report in English).
(Continued)

*Primary Examiner* — Binu Thomas
(74) *Attorney, Agent, or Firm* — Bejin Bieneman PLC

(57) ABSTRACT

An application device for the application in series of a paint or other coating compositions to motor vehicle bodies or add-on parts thereof has a nozzle print head which contains a plurality of nozzles arranged, for example, in one or more rows, which apply the coating composition to the surface to be coated as continuous jets or individual drops. The nozzle print head is arranged on a multi-axis coating robot. In contrast to application devices of this type known hitherto, the coating composition consists of at least two components
(Continued)

which are to be mixed together, such as, for example, 2K paint, which are fed to the nozzle print head via separate supply lines for jointly supplying the nozzles.

13 Claims, 3 Drawing Sheets

(51) Int. Cl.

| | |
|---|---|
| ***B05B 7/06*** | (2006.01) |
| ***B05B 12/04*** | (2006.01) |
| ***B05D 1/02*** | (2006.01) |
| ***B05B 13/04*** | (2006.01) |
| ***B41J 2/14*** | (2006.01) |
| ***B41J 3/407*** | (2006.01) |
| ***B05B 13/02*** | (2006.01) |
| ***B05B 16/00*** | (2018.01) |
| ***B05B 16/20*** | (2018.01) |
| *B41J 2/21* | (2006.01) |

(52) U.S. Cl.
CPC ..... *B05B 13/04* (2013.01); *B05B 13/0431* (2013.01); *B05B 13/0452* (2013.01); *B05B 15/55* (2018.02); *B05B 16/00* (2018.02); *B05B 16/20* (2018.02); *B05D 1/02* (2013.01); *B41J 2/1433* (2013.01); *B41J 3/4073* (2013.01); *B41J 2/211* (2013.01)

(56) References Cited

U.S. PATENT DOCUMENTS 3,981,320 A 9/1976 Wiggins
4,141,231 A 2/1979 Kudlich
4,375,865 A 3/1983 Springer
4,383,264 A 5/1983 Lewis
4,423,999 A 1/1984 Choly
4,430,010 A 2/1984 Zrenner et al.
4,435,719 A 3/1984 Snaper
4,478,241 A 10/1984 Cardenas-Franco
4,555,719 A 11/1985 Arway et al.
4,593,360 A 6/1986 Cocks
4,668,948 A 5/1987 Merkel
4,714,044 A 12/1987 Kikuchi
4,734,711 A 3/1988 Piatt et al.
4,826,135 A 5/1989 Mielke
4,894,252 A 1/1990 Bongen et al.
4,941,778 A 7/1990 Lehmann
4,974,780 A 12/1990 Nakamura et al.
4,985,715 A 1/1991 Cypher et al.
5,050,533 A 9/1991 Zaber
5,072,881 A 12/1991 Taube, III
5,429,682 A 7/1995 Harlow, Jr. et al.
5,435,884 A 7/1995 Simmons et al.
5,538,221 A 7/1996 Joswig
5,556,466 A 9/1996 Martin et al.
5,602,575 A 2/1997 Pauly
5,636,795 A 6/1997 Sedgwick et al.
5,647,542 A 7/1997 Diana
5,659,347 A 8/1997 Taylor
5,681,619 A 10/1997 Ogasawara
5,740,967 A 4/1998 Simmons et al.
5,843,515 A 12/1998 Crum et al.
5,951,882 A 9/1999 Simmons et al.
5,964,407 A 10/1999 Sandkleiva
5,976,343 A 11/1999 Schlaak
6,179,217 B1 1/2001 Osamu et al.
6,325,302 B1 12/2001 Guzowski
6,540,835 B2 4/2003 Kim et al.
6,607,145 B1 8/2003 Boriani et al.
6,641,667 B2 11/2003 Ochiai et al.
6,712,285 B2 3/2004 Provenaz et al.
6,777,032 B2 8/2004 Ogasahara et al.
6,811,807 B1 11/2004 Zimmermann et al.
6,849,684 B2 2/2005 Poppe et al.
7,160,105 B2 1/2007 Edwards
7,178,742 B2 2/2007 Nellentine et al.
7,182,815 B2 2/2007 Katagami et al.
7,244,310 B2 7/2007 Edwards
7,270,712 B2 9/2007 Edwards
7,357,959 B2 4/2008 Bauer
7,387,071 B2 6/2008 Heinke et al.
7,449,070 B2 11/2008 Fellingham
7,604,333 B2 10/2009 Horsnell
7,757,632 B2 7/2010 Edwards
7,837,071 B2 11/2010 Achrainer
7,901,741 B2 3/2011 Katagami et al.
8,028,651 B2 10/2011 Rademacher et al.
8,118,385 B2 2/2012 Van De Wynckel et al.
8,449,087 B2 5/2013 Kataoka et al.
8,545,943 B2 10/2013 Frankenberger et al.
8,652,581 B2 2/2014 Merchant
8,678,535 B2 3/2014 Beier et al.
8,875,655 B2 11/2014 Pettersson et al.
8,882,242 B2 11/2014 Beier et al.
9,010,899 B2 4/2015 Harjee et al.
9,108,424 B2 8/2015 Wallsten et al.
9,140,247 B2 9/2015 Herre et al.
9,156,054 B2 10/2015 Ikushima
9,266,353 B2 2/2016 Beier et al.
9,393,787 B2 7/2016 Ikushima
9,464,573 B2 10/2016 Remy et al.
9,592,524 B2 3/2017 Fritz et al.
9,701,143 B2 7/2017 Ikushima
9,707,585 B2 7/2017 Reimert et al.
9,844,792 B2 12/2017 Pettersson et al.
9,901,945 B2 2/2018 Fehr et al.
9,914,150 B2 3/2018 Pettersson et al.
10,016,977 B2 7/2018 Stefani et al.
10,105,946 B2 10/2018 Nakamura et al.
10,150,304 B2 12/2018 Herre et al.
10,252,552 B2 4/2019 Pitz et al.
10,272,677 B2 4/2019 Stefani et al.
10,532,569 B2 1/2020 Wallsten et al.
2001/0017085 A1 8/2001 Kubo et al.
2001/0019340 A1 9/2001 Kubo et al.
2002/0024544 A1 2/2002 Codos
2002/0043280 A1 4/2002 Ochiai et al.
2002/0043567 A1 4/2002 Provenaz et al.
2002/0105688 A1 8/2002 Katagami et al.
2002/0109741 A1 8/2002 Okabe et al.
2002/0128371 A1 9/2002 Poppe et al.
2003/0020783 A1 1/2003 Sanada
2003/0041884 A1 3/2003 Bahr
2003/0049383 A1 3/2003 Ogasahara et al.
2004/0028830 A1 2/2004 Bauer
2004/0089234 A1 5/2004 Hagglund et al.
2004/0107900 A1 6/2004 Clifford et al.
2004/0123159 A1 6/2004 Kerstens
2004/0173144 A1 9/2004 Edwards
2004/0221804 A1 11/2004 Zimmermann et al.
2004/0231594 A1 11/2004 Edwards
2004/0238522 A1 12/2004 Edwards
2004/0256501 A1 12/2004 Mellentine et al.
2004/0261700 A1 12/2004 Edwards
2005/0000422 A1 1/2005 Edwards
2005/0015050 A1 1/2005 Mowery et al.
2005/0016451 A1 1/2005 Edwards
2005/0023367 A1 2/2005 Reighard et al.
2005/0156963 A1 7/2005 Song et al.
2005/0243112 A1 11/2005 Kobayashi et al.
2006/0061613 A1 3/2006 Fienup et al.
2006/0068109 A1 3/2006 Frankenberger et al.
2006/0146379 A1 7/2006 Katagami et al.
2006/0238587 A1 10/2006 Horsnell
2006/0251796 A1 11/2006 Fellingham
2007/0062383 A1 3/2007 Gazeau
2007/0292626 A1 12/2007 Larsson et al.
2008/0271674 A1 11/2008 Rademarcher
2008/0309698 A1 12/2008 Nakano et al.
2009/0027433 A1 1/2009 Van De Wynckel et al.
2009/0029069 A1 1/2009 Edwards
2009/0117283 A1 5/2009 Herre

(56) References Cited

U.S. PATENT DOCUMENTS

| | | | | |
|---|---|---|---|---|
| 2009/0181182 | A1* | 7/2009 | Sloan | C09D 11/101 524/533 |
| 2010/0132612 | A1 | 6/2010 | Achrainer | |
| 2010/0156970 | A1 | 6/2010 | Ikushima | |
| 2010/0170918 | A1 | 7/2010 | Achrainer | |
| 2010/0225685 | A1* | 9/2010 | Kwon | B01F 15/0255 347/9 |
| 2010/0279013 | A1 | 11/2010 | Frankenberger et al. | |
| 2010/0282283 | A1 | 11/2010 | Bauer | |
| 2010/0321448 | A1 | 12/2010 | Buestgens et al. | |
| 2011/0014371 | A1* | 1/2011 | Herre | B05B 13/0431 118/317 |
| 2011/0084150 | A1 | 4/2011 | Merchant | |
| 2011/0248046 | A1 | 10/2011 | Simion | |
| 2011/0262622 | A1* | 10/2011 | Herre | B05C 11/1005 118/300 |
| 2012/0085842 | A1 | 4/2012 | Ciardella | |
| 2012/0105522 | A1 | 5/2012 | Wallsten | |
| 2012/0114849 | A1 | 5/2012 | Melcher | |
| 2012/0162331 | A1 | 6/2012 | Kataoka | |
| 2012/0186518 | A1 | 7/2012 | Herre | |
| 2012/0219699 | A1 | 8/2012 | Pettersson et al. | |
| 2012/0249679 | A1 | 10/2012 | Beier et al. | |
| 2012/0282405 | A1* | 11/2012 | Herre | B05B 13/0627 118/313 |
| 2013/0201243 | A1 | 8/2013 | Yoshida | |
| 2013/0215203 | A1 | 8/2013 | Chen | |
| 2013/0257984 | A1 | 10/2013 | Beier et al. | |
| 2013/0284833 | A1* | 10/2013 | Fritz | B05B 13/0452 239/690 |
| 2014/0076985 | A1 | 3/2014 | Pettersson et al. | |
| 2014/0242285 | A1 | 8/2014 | Pettersson et al. | |
| 2014/0329001 | A1 | 11/2014 | Rouaud et al. | |
| 2015/0009254 | A1 | 1/2015 | Kaiba et al. | |
| 2015/0042716 | A1 | 2/2015 | Beier et al. | |
| 2015/0086723 | A1 | 3/2015 | Bustgens | |
| 2015/0098028 | A1 | 4/2015 | Ohnishi | |
| 2015/0328654 | A1 | 11/2015 | Schwab | |
| 2015/0375258 | A1 | 12/2015 | Fritz et al. | |
| 2015/0375507 | A1 | 12/2015 | Ikushima | |
| 2016/0052312 | A1 | 2/2016 | Pitz et al. | |
| 2016/0074822 | A1 | 3/2016 | Han | |
| 2016/0288552 | A1 | 10/2016 | Ikushima | |
| 2016/0306364 | A1 | 10/2016 | Ikushima et al. | |
| 2017/0087837 | A1 | 3/2017 | Stefani et al. | |
| 2017/0106393 | A1 | 4/2017 | Hamspon et al. | |
| 2017/0136481 | A1 | 5/2017 | Fritz et al. | |
| 2017/0252765 | A1 | 9/2017 | Medard | |
| 2017/0267002 | A1 | 9/2017 | Pitz et al. | |
| 2017/0299088 | A1 | 10/2017 | Rau | |
| 2017/0361346 | A1* | 12/2017 | Lahidjanian | B05B 13/0431 |
| 2018/0022105 | A1 | 1/2018 | Nakamura et al. | |
| 2018/0056670 | A1 | 3/2018 | Kerr | |
| 2018/0093491 | A1 | 4/2018 | Murayama et al. | |
| 2018/0178505 | A1 | 6/2018 | Stefani et al. | |
| 2018/0222186 | A1 | 8/2018 | Stefani et al. | |
| 2018/0250955 | A1 | 9/2018 | Herre | |
| 2019/0091712 | A1 | 3/2019 | Medard et al. | |

FOREIGN PATENT DOCUMENTS

| | | | |
|---|---|---|---|
| CN | 1438942 | A | 8/2003 |
| CN | 1512919 | A | 7/2004 |
| CN | 1176815 | C | 11/2004 |
| CN | 1668386 | A | 9/2005 |
| CN | 1761530 | A | 4/2006 |
| CN | 101264698 | A | 9/2008 |
| CN | 101309755 | A | 11/2008 |
| CN | 101657264 | A | 2/2010 |
| CN | 101784348 | A | 7/2010 |
| CN | 102177002 | A | 9/2011 |
| CN | 102198434 | A | 9/2011 |
| CN | 102971080 | A | 3/2013 |
| CN | 103153483 | A | 6/2013 |
| CN | 103909743 | A | 7/2014 |
| CN | 104613205 | A | 5/2015 |
| CN | 104994966 | A | 10/2015 |
| CN | 105358259 | A | 2/2016 |
| CN | 205042649 | U | 2/2016 |
| CN | 106414081 | A | 2/2017 |
| DE | 1284250 | A | 11/1968 |
| DE | 7710895 | U1 | 9/1977 |
| DE | 3045401 | A1 | 7/1982 |
| DE | 3221327 | A1 | 9/1983 |
| DE | 3225554 | A1 | 1/1984 |
| DE | 3634747 | A1 | 8/1987 |
| DE | 3804092 | A1 | 9/1988 |
| DE | 4013322 | A1 | 10/1991 |
| DE | 4115111 | A1 | 11/1991 |
| DE | 4138491 | A1 | 5/1993 |
| DE | 9405600 | U1 | 6/1994 |
| DE | 68924202 | T2 | 2/1996 |
| DE | 19606716 | C1 | 8/1997 |
| DE | 19630290 | A1 | 1/1998 |
| DE | 19731829 | A1 | 1/1999 |
| DE | 19743804 | A1 | 4/1999 |
| DE | 9422327 | U1 | 3/2000 |
| DE | 19852079 | A1 | 5/2000 |
| DE | 19936790 | A1 | 2/2001 |
| DE | 20017629 | U1 | 3/2001 |
| DE | 10048749 | A1 | 4/2002 |
| DE | 69429354 | T2 | 5/2002 |
| DE | 69622407 | T2 | 3/2003 |
| DE | 10307719 | A1 | 9/2003 |
| DE | 60001898 | T2 | 2/2004 |
| DE | 102004021223 | A1 | 12/2004 |
| DE | 10331206 | A1 | 1/2005 |
| DE | 102004034270 | A1 | 2/2006 |
| DE | 102004044655 | A1 | 3/2006 |
| DE | 102004049471 | A1 | 4/2006 |
| DE | 60212523 | T2 | 2/2007 |
| DE | 69836128 | T2 | 8/2007 |
| DE | 60125369 | T2 | 10/2007 |
| DE | 102006021623 | A1 | 11/2007 |
| DE | 102006056051 | A1 | 5/2008 |
| DE | 102007018877 | A1 | 10/2008 |
| DE | 60132100 | T2 | 12/2008 |
| DE | 102007037663 | A1 | 2/2009 |
| DE | 10 2008 018 881 | A1 | 9/2009 |
| DE | 102008053178 | A1 | 5/2010 |
| DE | 102009029946 | A1 | 12/2010 |
| DE | 102009038462 | A1 | 3/2011 |
| DE | 102010004496 | A1 | 7/2011 |
| DE | 102010019612 | A1 | 11/2011 |
| DE | 102012006371 | A1 | 7/2012 |
| DE | 102012005087 | A1 | 10/2012 |
| DE | 102012005650 | A1 | 9/2013 |
| DE | 102012212469 | A | 1/2014 |
| DE | 102012109123 | A1 | 3/2014 |
| DE | 202013101134 | U1 | 6/2014 |
| DE | 102013002412 | A1 | 8/2014 |
| DE | 102013011107 | A1 | 8/2014 |
| DE | 102013205171 | A1 | 9/2014 |
| DE | 102014006991 | A1 | 12/2014 |
| DE | 102014007523 | A1 | 11/2015 |
| DE | 102014008183 | A1 | 12/2015 |
| DE | 10 2014 217 892 | A1 | 3/2016 |
| DE | 102014012705 | A1 | 3/2016 |
| DE | 102014013158 | A1 | 3/2016 |
| DE | 10 2016 014 952 | A1 | 6/2018 |
| EP | 0138322 | A1 | 4/1985 |
| EP | 0297309 | A2 | 1/1989 |
| EP | 0665106 | A2 | 8/1995 |
| EP | 1120258 | A2 | 8/2001 |
| EP | 1270086 | A1 | 1/2003 |
| EP | 1764226 | A1 | 3/2007 |
| EP | 1852733 | A1 | 11/2007 |
| EP | 1884365 | A1 | 2/2008 |
| EP | 1946846 | A2 | 7/2008 |
| EP | 2002898 | A1 | 12/2008 |
| EP | 2133154 | A2 | 12/2009 |
| EP | 2151282 | A1 | 2/2010 |
| EP | 2196267 | A2 | 6/2010 |

(56) References Cited

FOREIGN PATENT DOCUMENTS

| | | | |
|---|---|---|---|
| EP | 2380744 | A2 | 10/2011 |
| EP | 2433716 | A1 | 3/2012 |
| EP | 2468512 | A1 | 6/2012 |
| EP | 2641661 | A1 | 9/2013 |
| EP | 2644392 | A2 | 10/2013 |
| EP | 2777938 | A1 | 9/2014 |
| EP | 2799150 | A1 | 11/2014 |
| EP | 2842753 | A1 | 3/2015 |
| EP | 3002128 | A2 | 4/2016 |
| EP | 3156138 | A1 | 4/2017 |
| EP | 3213823 | A1 | 9/2017 |
| EP | 3257590 | A1 | 12/2017 |
| EP | 3272669 | A1 | 1/2018 |
| EP | 3068626 | B1 | 10/2019 |
| FR | 3010918 | A1 | 3/2015 |
| GB | 2200433 | A | 8/1988 |
| GB | 2367771 | A | 4/2002 |
| GB | 2507069 | A | 4/2014 |
| JP | S5722070 | A | 2/1982 |
| JP | S62116442 | A | 5/1987 |
| JP | H04-106669 | U | 9/1992 |
| JP | H0798171 | B2 | 10/1995 |
| JP | H09192583 | A | 7/1997 |
| JP | 2000158670 | A | 6/2000 |
| JP | 2000317354 | A | 11/2000 |
| JP | 2001129456 | A | 5/2001 |
| JP | 2001157863 | A | 6/2001 |
| JP | 2001239652 | A | 9/2001 |
| JP | 2001300404 | A | 10/2001 |
| JP | 2005501745 | A | 1/2002 |
| JP | 2002361863 | A | 12/2002 |
| JP | 2003506210 | A | 2/2003 |
| JP | 2003136030 | A | 5/2003 |
| JP | 2003164780 | A | 6/2003 |
| JP | 2004142382 | A | 5/2004 |
| JP | 2004528956 | A | 9/2004 |
| JP | 2004337710 | A | 12/2004 |
| JP | 2005526234 | A | 9/2005 |
| JP | 2007021760 | A | 2/2007 |
| JP | 2007152666 | A | 6/2007 |
| JP | 2007520340 | A | 7/2007 |
| JP | 2007245633 | A | 9/2007 |
| JP | 2007289848 | A | 11/2007 |
| JP | 2008110332 | A | 5/2008 |
| JP | 2009006324 | A | 1/2009 |
| JP | 2010528852 | A | 8/2010 |
| JP | 2010531213 | A | 9/2010 |
| JP | 2010531729 | A | 9/2010 |
| JP | 2010241003 | A | 10/2010 |
| JP | 2011206958 | A | 10/2011 |
| JP | 2012011310 | A | 1/2012 |
| JP | 2012506305 | A | 3/2012 |
| JP | 2012135925 | A | 7/2012 |
| JP | 2012206116 | A | 10/2012 |
| JP | 2012228643 | A | 11/2012 |
| JP | 2012228660 | | 11/2012 |
| JP | 2013067179 | A | 4/2013 |
| JP | 2013530816 | A | 8/2013 |
| JP | 2013530816 | B2 | 8/2013 |
| JP | 2013188706 | A | 9/2013 |
| JP | 2014019140 | A | 2/2014 |
| JP | 2014050832 | A | 3/2014 |
| JP | 2014111307 | A | 6/2014 |
| JP | 2015-009222 | A | 1/2015 |
| JP | 2015027636 | A | 2/2015 |
| JP | 2015096322 | A | 5/2015 |
| JP | 2015520011 | A | 7/2015 |
| JP | 2015193129 | A | 11/2015 |
| JP | 2015535735 | A | 12/2015 |
| JP | 2016507372 | A | 3/2016 |
| JP | 2016526910 | A | 9/2016 |
| JP | 2016175077 | A | 10/2016 |
| JP | 2016175662 | A | 10/2016 |
| JP | 2018012065 | A | 1/2018 |
| JP | 2020513311 | A | 5/2020 |
| JP | 2020513314 | A | 5/2020 |
| WO | 8601775 | A1 | 3/1986 |
| WO | 9856585 | A1 | 12/1998 |
| WO | 02098576 | A1 | 12/2002 |
| WO | 03021519 | A1 | 3/2003 |
| WO | 2003062129 | A2 | 7/2003 |
| WO | 2004048112 | A1 | 6/2004 |
| WO | 2004085738 | A2 | 10/2004 |
| WO | 2005016556 | A1 | 2/2005 |
| WO | 2005075170 | A1 | 8/2005 |
| WO | 2006022217 | A1 | 3/2006 |
| WO | 2007121905 | A1 | 11/2007 |
| WO | 2009019036 | A1 | 2/2009 |
| WO | 2010046064 | A1 | 4/2010 |
| WO | 2010146473 | A1 | 12/2010 |
| WO | 2011044491 | A1 | 4/2011 |
| WO | 2011128439 | A1 | 10/2011 |
| WO | 2011138048 | A1 | 11/2011 |
| WO | 2013121565 | A1 | 8/2013 |
| WO | 2015071270 | A1 | 5/2015 |
| WO | 2015096322 | A1 | 7/2015 |
| WO | 2015186014 | A1 | 12/2015 |
| WO | 2016-087016 | A1 | 6/2016 |
| WO | 2016142510 | A1 | 9/2016 |
| WO | 2016145000 | A1 | 9/2016 |
| WO | 2017006245 | A1 | 1/2017 |
| WO | 2017006246 | A1 | 1/2017 |
| WO | 2018102846 | | 6/2018 |
| WO | 2018108565 | A1 | 6/2018 |

OTHER PUBLICATIONS

Ghasem, G. et al.; "Chapter 2 Background on Sprays and Their Production", Industrial Sprays and Atomization: Design, Analysis and Applications, Jan. 1, 2002, Springer, London, pp. 7-33, XP009195118, ISBN: 978-1-4471-3816-7.

International Search Report and Written Opinion for PCT/EP2017/081141 dated Feb. 26, 2018 (17 pages; with English translation).

International Search Report and Written Opinion for PCT/EP2017/081114 dated May 15, 2018 (33 pages; with English translation).

Anonymous: "Roboterkalibrierung—Wikipedia", Nov. 7, 2016, XP055471615, Gefunden im Internet: URL: https://de.wikipedia.org/w/index.php?title=Roboterkalibrierung&oldid=159460756 [gefunden am Apr. 30, 2018] das ganze dockument (8 pages; with English translation).

Beyer, Lukas: "Genauigkeitssteigerung von Industrierobotern", Forschungsberichte Aus Dem Laboratorium Fertigungstechnik/Helmut-Schmidt-Universitat, Universitat Der Bundeswehr Hamburg, Dec. 31, 2005, Seiten 1-4, XP009505118; ISSN: 1860-2886; ISBN: 978-3-8322-3681-6 (13 pages; with English machine translation).

International Search Report and Written Opinion for PCT/EP2017/081108 dated Feb. 28, 2018 (with English translation; 18 pages).

International Search Report and Written Opinion for PCT/EP2017/081099 dated Feb. 26, 2018 (21 pages; with English translation).

International Search Report and Written Opinion for PCT/EP2017/081102 dated Mar. 14, 2018 (16 pages; with English translation).

International Search Report and Written Opinion for PCT/EP2017/081105 dated Feb. 26, 2018 (19 pages; with English translation).

International Search Report and Written Opinion for PCT/EP2017/081152 dated May 15, 2018 (25 pages; with English translation).

International Search Report and Written Opinion for PCT/EP2017/081098 dated May 14, 2018 (26 pages; with English translation).

International Search Report and Written Opinion for PCT/EP2017/081101 dated Feb. 28, 2018 (14 pages; with English translation).

International Search Report and Written Opinion for PCT/EP2017/081121 dated Feb. 26, 2018 (20 pages; with English translation).

International Search Report and Written Opinion for PCT/EP2017/081117 dated Mar. 12, 2018 (27 pages; with English translation).

International Search Report and Written Opinion for PCT/EP2017/081123 dated Feb. 26, 2018 (20 pages; with English translation).

European Search Report for EP20170638.9 dated Sep. 14, 2020 (4 pages—English translation not available).

(56) References Cited

OTHER PUBLICATIONS

European Search Report for EP20170021.8 dated Sep. 8, 2020 (11 pages—English translation not available).
European Search Report for EP20170025.9 dated Sep. 9, 2020 (4 pages—English translation not available).
European Search Report for EP20170016.8 dated Sep. 7, 2020 (4 pages—English translation not available).
Non-Final Office Action dated Apr. 28, 2021 for U.S. Appl. No. 16/468,693 (109 pages).
Final Office Action dated Apr. 19, 2021 for U.S. Appl. No. 16/468,700 (62 pages).
Non-Final Office Action for U.S. Appl. No. 16/468,691 dated Jan. 7, 2021 (79 pages).
Chinese Office Action for Application No. CN20178007017.9 dated Aug. 31, 2020 (8 pages; with English translation).
Non Final Office Action for U.S. Appl. No. 16/468,697 dated Oct. 22, 2020 (78 pages).
Non Final Office Action for U.S. Appl. No. 16/468,696 dated Nov. 2, 2020 (58 pages).
Non Final Office Action for U.S. Appl. Mo. 16/468,689 dated Oct. 15, 2020 (77 pages).
Chinese Office Action for CN201780077476.7 dated Sep. 23, 2020 (12 pages; English translation not available).
Non Final Office Action for U.S. Appl. No. 16/468,700 dated Dec. 1, 2020 (73 pages).
Chinese Office Action and Search Report for CN201780077603.3 dated Oct. 12, 2020 (15 pages; English translation not available).
JPO Submission for JP2019-531096; submitted Dec. 21, 2020 (32 pages; with English translation).
JPO Submission for JP2019-531957; submitted Dec. 21, 2020 (21 pages; with English translation).
EPO Examination Report for Application No. 201702818.1 dated Dec. 18, 2020 (with English machine translation; 6 pages).
Final Office Action dated Mar. 19, 2021 for U.S. Appl. No. 16/468,696 (45 pages).
EPO Official Notification of Opposition for Application No. 17821803.8 dated Feb. 10, 2021 (64 pages; with English machine translation).
Non-Final Office Action dated Feb. 18, 2021 for U.S. Appl. No. 16/468,692 (97 pages).
Notice of Allowance mailed in U.S. Appl. No. 16/468,689 dated Jun. 2, 2021 (38 pages).
Fianl Office Action dated May 13, 2021 for U.S. Appl. No. 16/468,691 (70 pages).
JPO Notification of Reasons for Rejection for Application No. JP2019-532030 dated May 18, 2021 (6 pages; with English translation).
CIPO Office Action for Application No. CN201780077474.8 dated Apr. 26, 2021 (17 pages; with English translation).
Notification of Reasons for Refusal for Application No. JP2019-532012 dated Jun. 22, 2021 (6 pages; with English machine translation).
Notification of Reasons for Refusal for Application No. JP2019-527330 dated Jun. 22, 2021 (10 pages; with English machine translation).
Chinese Office Action dated Jun. 2, 2021 for Application No. CN201780077017 9 (17 pages; with English machine translation).
Japanese Notification of Reasons for Rejection dated Jun. 1, 2021 for Application No. JP2019-531944 (14 pages; with English machine translation).
Japanese Notification of Reasons for Rejection dated Jun. 8, 2021 for Application No. JP2019-531957 (13 pages; with English machine translation).
Supplemental Notice of Allowability dated Jul. 8, 2021 for U.S. Appl. No. 16/468,696 (11 pages).
Liptak, Bela. (2006). Instrument Engineers' Handbook (4th Edition)—Process Control and Optimization, vol. 2—2.1.3.5 Process Time Constant, (pp. 99-102). Taylor & Francis. Retrieved from https://app.knovel.eom/hotlink/pdf/id:kt00CC7HL1/instrument-engineers/process-time-constant (Year: 2006).
Japenese Patent Office Notice of Reasons of Refusal for Application No. JP 2019-531967 dated Jun. 8, 2021 (8 pages; with English machine translation).
JPO Office Action dated Jul. 3, 2021 for Application No. JP2019-532024 (12 pages; with English machine translation).
Non-Final Office Action dated Aug. 27, 2021 for U.S. Appl. No. 16/468,695 (149 pages).
JPO Decision to Grant dated Oct. 3, 2021 for Application No. JP2019-532113 (7 pages; with English machine translation).
Final Office Action dated Oct. 7, 2021 for U.S. Appl. No. 16/468,693 (58 pages).
JPO Office Action for Application No. JP2019-531097 dated Jun. 29, 2021 (10 pages; with English machine translation).
JPO Office Action for Application No. 2019-531096 dated Jul. 6, 2021 (9 pages; with English machine translation).
JPO Office Action for Application No. 2019-531098 dated Jul. 6, 2021 (5 pages; English translation only).
JPO Office Action for Application No. 2019-531459 dated Jul. 6, 2021 (8 pages; with English machine translation).
Non-Final Office Action dated Dec. 24, 2021 for related U.S. Appl. No. 16/468,693 (19 pages).
Chinese Office Action in related application No. CN201780077045.0 dated Jan. 29, 2022 (17 pages; English machine translation provided).
Non Final Office Action dated Nov. 23, 2021 for U.S. Appl. No. 16/468,694 (163 pages).
JPO Decision to Grant in related application No. JP2019-532030 dated Dec. 1, 2022 (6 pages; English machine translation provided).
Non-Final Office Action for related U.S. Appl. No. 16/468,699 dated Mar. 9, 2022 (180 pages).
JPO Decision to Grant in related application JP2019-532012 dated Jan. 25, 2022 (6 pages; with English machine translation).
EPO Notification of Objection dated May 18, 2022 for Patent No. EP3718643, related to related U.S. Appl. No. 16/468,693 (55 pages; with English machine translation).

* cited by examiner

APPLICATION DEVICE AND METHOD FOR APPLYING A MULTICOMPONENT COATING MEDIUM

CROSS-REFERENCE TO RELATED APPLICATIONS

This application is a national stage of, and claims priority to, Patent Cooperation Treaty Application No. PCT/EP2017/081123, filed on Dec. 1, 2017, which application claims priority to German Application No. DE 10 2016 014 919.1, filed on Dec. 14, 2016, which applications are hereby incorporated herein by reference in their entireties.

BACKGROUND

The disclosure relates to an application device for the application in series of a coating composition to surfaces of workpieces, in particular of motor vehicle bodies and/or add-on parts thereof, having a nozzle applicator, referred to as a nozzle print head hereinbelow, which contains at least one nozzle or preferably a plurality of nozzles arranged side by side, which apply the coating composition to the surface to be coated as continuous jets or individual drops. "Application device" means a device which, in addition to the nozzle print head, which in particular is moved by means of a coating robot, can include further units such as the supply unit containing the coating composition and optionally mixers, colour changers and/or a flushing device. The disclosure relates further to a corresponding application and/or cleaning method.

For the general prior art, reference may first be made, for example, to DE 10 2010 019 612 A1, GB 2 367 771 A, DE 10 2013 002 412 A1, DE 198 52 079 A1, WO 2011/044491 A1, DE 200 17 629 U1, DE 694 29 354 T2 and DE 601 25 369 T2.

So-called nozzle print heads are known inter alia from WO 2010/046064 A1 (for continuous jets of paint) and WO 2011/138048 A1 (for generating drops of paint by applying vibration to the coating composition) and allow motor vehicle bodies to be coated, specifically painted, virtually without overspray, because the jets or drops can be directed with point accuracy at the desired surface regions. Coating without overspray has the considerable advantages described, for example, in the mentioned WO 2010/046064 A1 such as minimal losses of coating material and simplification of the coating booth by dispensing with the measures hitherto required for removing the overspray from a painting booth and/or from a waste air stream.

Nevertheless, such print heads can operate with a surface coating capacity of at least 1 $m^2$/min, 2 $m^2$/min, 3 $m^2$/min, 4 $m^2$/min or even 5 $m^2$/min. The application efficiency of the print head can be more than 80%, 90% or even 99%, and in the coating booth the rate of air descent during operation can be less than 0.3 m/s, 0.2 m/s, 0.1 m/s, 0.07 m/s or even 0.05 m/s.

An important component of the nozzle print head can be a nozzle plate having openings formed in a plate plane which serve as nozzles.

All the above-mentioned features and advantages of the mentioned known nozzle print heads also apply to the disclosure described herein.

Furthermore, there is also known, for example, from U.S. Pat. No. 9,108,424 B2 a nozzle print head having a row of ink-jet nozzles for printing a surface with predetermined patterns, which print head works according to the so-called drop-on-demand principle. This principle is based on the use of electric valves, wherein a magnetic valve needle is guided as the plunger in a coil and is pulled up into the coil by supplying a current. A valve opening is thereby freed so that the fluid in question, in this case the ink, is able to emerge as drops of different sizes depending on the opening time. This principle can also be used in the disclosure described herein but, in contrast to the prior art, not for ink.

The above-mentioned application devices and other nozzle print heads that are already known all have the disadvantage that they are unable to satisfactorily apply multicomponent coating compositions such as, for example, the 2K or 3K paints, adhesives, sealants, adhesion promoters, primers, etc. which are conventional per se in the painting of motor vehicle bodies.

DETAILED DESCRIPTION

Figure 1:
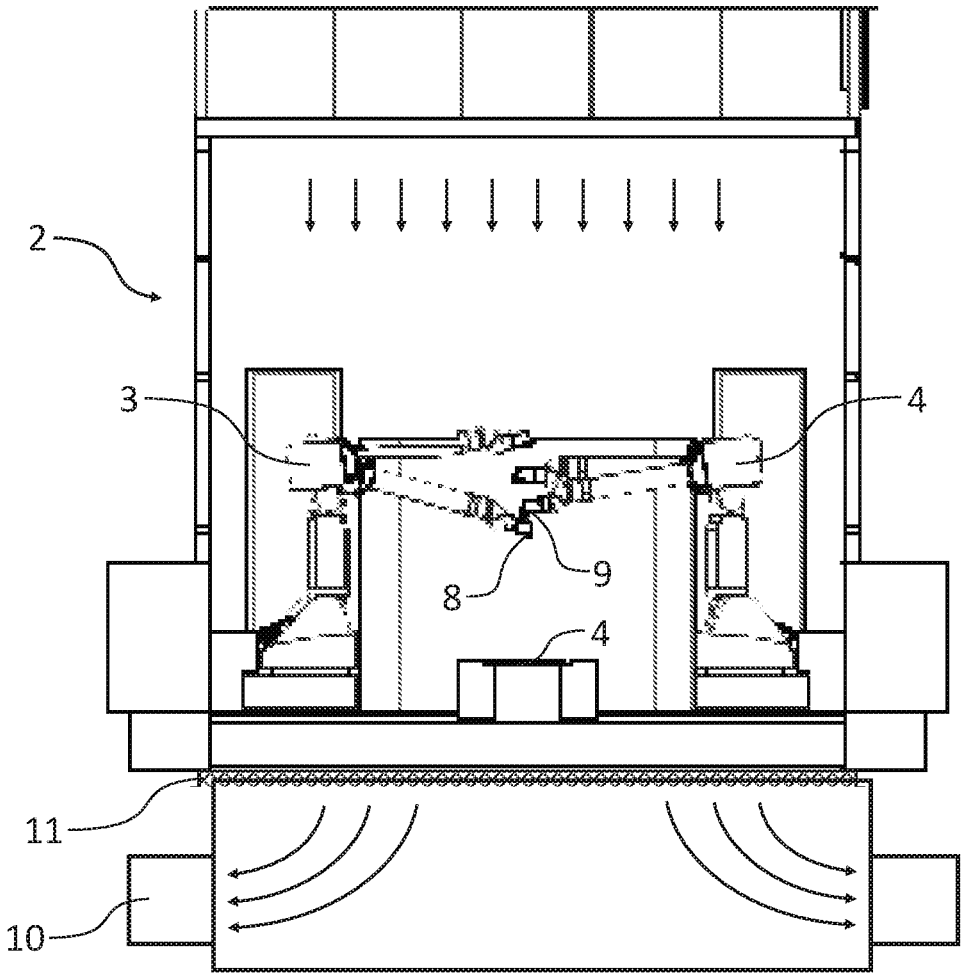
FIG. 1 is a cross-sectional view through a painting system according to the disclosure for painting motor vehicle body components having print heads as the application devices.

The application device according to the disclosure first has, in accordance with the prior art, a nozzle applicator or nozzle print head for applying the coating composition to the component to be coated. The term "nozzle print head" used within the context of the disclosure is to be interpreted generally and serves merely to differentiate this nozzle applicator from all atomizers (e.g. rotary atomisers, air atomisers, airless atomisers, etc.) that deliver a spray mist of the coating composition to be applied. In contrast therewith, the nozzle print head generates radially narrowly limited coating agent jets or drops, whereby the jet is generated continuously, that is to say cohesively in its longitudinal direction, while the drops each travel in the same direction and are to be separate from one another in the direction of travel. In principle, it is conceivable that the nozzle print head contains only a single nozzle to which the already mixed coating composition is fed, or only two nozzles, of which one nozzle delivers a first component and the other nozzle delivers a second component. However, preference is given to print heads having a plurality of, for example, one or more parallel rows of nozzles.

The disclosure can moreover be implemented with all types of print heads or other nozzle applicators which differ from conventional atomisers in the manner mentioned above.

In addition, there are provided according to the disclosure at least one or two separate supply lines for components of the coating composition which are to be mixed together, which supply lines in typical examples of the disclosure are provided for jointly supplying all the nozzles of the print head with the same coating composition or components thereof. At least two separate supply lines lead to or into the nozzle print head if the components are to be mixed therein or not until they have left the nozzle print head. If, on the other hand, mixing is to take place in a mixer arranged outside the nozzle print head, one line leading from the outlet thereof into the nozzle print head is sufficient. In typical exemplary examples, the components are at least one material component (e.g. batch paint) and at least one curing agent component which reacts in a manner known per se with the material component for the curing thereof. In an exemplary examples of the disclosure, the components remain separate at least until they enter the nozzle print head.

One advantage of the disclosure is that the fully automatic surface coating, particularly painting, in series of complete motor vehicle bodies using any desired multicomponent coating agents (including special-effect paints) is for the first time possible virtually without overspray.

As has already been mentioned, the nozzles of the print head are to direct the jets or drops of the coating composition or its components targetedly at individual points of the surface to be coated in order to avoid overspray. The impact points thereby applied can adjoin one another or overlap with one another, as will be described in greater detail.

In accordance with the prior art, it is also advantageous in the disclosure to arrange the nozzle print head on a multi-axis coating robot which moves the nozzle print head over the surface to be coated. For example, reference may be made in this connection to the coating robots having 6 or more axes, with or without a linear movement axis, which are generally known per se from the prior art.

However, the disclosure is not limited to conventional robots having 6 or more rotary axes. Instead, the nozzle applicator could be arranged, for example, on a linear unit which substantially has only linear axes for moving the nozzle print head, advantageously under program control, over the surface to be coated. Such a linear unit could be placed, for example, temporarily on the workpiece to be coated, for example on a body roof, or instead also on the conveyor thereof (e.g. the conventional skids) and would then have the advantage that accuracy problems of conventional robot and conveyor systems as regards the positioning of the nozzle print head relative to the workpiece can be avoided.

As has likewise already been discussed, the disclosure is suitable for any desired multicomponent coating compositions such as, for example, 2K or 3K paint (including base paint and clear paint), primers, adhesives or sealants or preserving agents, etc., which each have at least one batch component and a curing agent component which reacts therewith.

Mixing of the components can be carried out in different ways and at different locations of the application system.

For example, the nozzle print head can direct the at least two components separately from one another onto the surface to be coated in such a manner that they mix together on the surface. Mixing of the components thus takes place here as a result of the impact of the drops or jets. It is possible that the print head ejects the components to be mixed simultaneously. In other examples of the disclosure, however, the print head ejects the components to be mixed in succession in time, that is to say first one and then the other component (for example first the batch paint and then the curing agent, or vice versa). In both cases, the jets or drops strike at substantially the same point.

According to another possibility of the disclosure, mixing can also take place in mid-air, that is to say the nozzles of the print head are so arranged relative to one another that the components meet on the path to the surface to be coated. An appropriate distance between the nozzle print head and the surface to be coated must here be maintained, for example, by means of the coating robot. Furthermore, it is possible that the drops of the components of the coating composition are ejected at different speeds and at different times so that the drop that is ejected later meets the drop ejected first in mid-air and mixes therewith.

As has already been mentioned, drops of different sizes can be generated using, for example, electric-valve-controlled nozzles. According to the disclosure it is possible by means of different drop sizes to adjust inter alia the mixing ratio if the components are not mixed until after they have left the nozzles.

According to a further possibility of the disclosure, however, mixing can also take place at or in the nozzle print head, for example by means of a mixer which, in a manner known per se, can be in the form of a static or dynamic mixer. The mixer can be arranged in or at the nozzle print head, for example integrated in the print head in a respective inflow passage of the nozzles, where it is connected to the at least two separate supply lines of the application device.

According to another possibility for mixing the components in the print head, the individual nozzles of the nozzle print head can also each be configured for mixing the components. According to a corresponding exemplary example of the disclosure, the respective nozzles can contain at least two passages leading to a nozzle outlet, which passages can extend concentrically to one another in this example, whereby the nozzle outlet can be formed by at least one annular gap and a central opening. In this exemplary example, each nozzle of the nozzle print head is thus actually a unit having at least two nozzle elements, namely the outlet openings of this nozzle unit.

In particular in each of the mentioned possibilities for mixing without a mixer, it can be advantageous to impart a swirling motion to at least one of the components, but preferably to both or all the components, whereby they mix better.

If the components are not mixed via a mixer, it can be necessary in the case of the application of cohesive jets to ensure the mixing ratio of the two components by regulating the volume flow rate of the two components. In the case of the application of drops, the mixing ratio can be controlled via the volume of the drops, for example by means of different opening times of the nozzles.

If a mixer is to be provided, it could also be integrated according to a further possibility of the disclosure into the supply lines outside the print head, preferably as close as possible to the nozzle print head or in the vicinity of a colour changer. The mixer has corresponding inlets, at which it is connected to the at least two separate supply lines, while its outlet is connected to the nozzle(s) via a common line.

Controlled colour change valve arrangements, conventionally referred to as colour changers, for selecting a desired coloured paint from a plurality of supplied different colours are generally known per se. In the case of the disclosure too, at least one colour changer can be provided which is connected to at least one of the supply lines of the application device or of the nozzle print head, for example for a batch paint component. The colour changer can advantageously be movably arranged, in particular on the coating robot which moves the nozzle print head, for example on one of its arms or also on a linear movement axis of the robot. The closer the colour changer to the nozzle print head, the smaller the unavoidable paint and flushing medium losses in the event of a colour change. However, the colour changer can instead also be arranged stationarily, for example on an inside or outside wall of the coating booth of the coating system in question here.

The nozzle print head can be formed by a nozzle plate which, as nozzles, contains openings arranged side by side in a plate plane. The nozzles can preferably be arranged in one or more parallel rows, for example also as columns and rows of a matrix. In corresponding examples of the disclosure, the longitudinal axes of the nozzles can extend perpendicularly to the plate plane. In other examples, on the other hand, the longitudinal axes of adjacent nozzles are inclined relative to the plate plane by different or equal angles, for example opposite equal angles.

For automatically controlling their opening times, the nozzles can be connected, for example within the scope of the program control conventional for coating systems, with electric or pneumatically controlled valves arranged in or on the nozzle print head, optionally, for example, on the nozzle plate.

The control valves can have, for example, a plunger which is displaceable electrically by a coil or pneumatically and which closes or opens the nozzle depending on its position.

According to an aspect of the application device according to the disclosure which is important especially for multicomponent coating compositions is the cleaning thereof before and after coating operations. For example, the nozzle print head can be flushed after a specified time or operating period, for example hourly or after several hours or at specific times of day (end of a shift or production, weekend) etc. or when a specific number of coated workpieces has been reached or when a specific amount of ejected paint has been reached. It can likewise be expedient to flush the nozzle print head after specific events of the coating operation, for example after every stoppage of a belt or other conveyor device conveying the vehicle bodies or other workpieces to be coated through a coating booth in the conventional manner, or after a predetermined number of conveyor stoppages. Flushing can also take place under signal control after a predetermined period of time has elapsed, for example as a result of an alarm or fault warning signal after the elapse of a period of time after which the reaction of two components is so far advanced that the application system must be flushed in order to avoid damage. In the case of the coating of bodies, flushing can also take place during the so-called body gaps, that is to say when, in the breaks after the coating of one body, the robot is waiting for the next body conveyed through the coating booth. The flushing operations can be controlled automatically in dependence on time monitoring devices.

Different flushing media can be used for the cleaning, depending on the application. For example, in the case of a change of the coating operation between solvent-based (2K) paint and water-borne paint, different flushing media may be advantageous in each case, whereby a separating agent such as, for example, an alcohol can additionally also be used between the two flushing media. Furthermore, flushing media with different cleaning actions can be used (cascading), for example for reducing VOC emissions (that is to say volatile organic compounds) when the content of organic solvent increases in an aqueous flushing medium. Universal flushing media for water-borne paint and solvent-borne paint are, however, also known. VOC-free flushing medium is preferably used. For this purpose, different flushing programs, which differ in terms of their program sequence and/or their duration, can be used for different paints.

It can further be advantageous, in particular before a planned break in operation, to fill or wet the inside or outside surfaces of the nozzle print head that come into contact with one or more components of the coating composition with a fluid which at least substantially prevents deposits of the coating composition and/or the reaction of two components of the coating composition (within the scope of the disclosure, reaction generally means a chemical and/or curing reaction).

For flushing, flushing medium and pulsed air can be supplied alternately in a manner known per se. In addition or instead, flushing can also be carried out using an aerosol. If it is found to be necessary after flushing, the flushed paths can subsequently be emptied or dried with compressed air.

After flushing, it is advantageous to fill the paths in question with the coating composition or the components thereof again before the start of coating, which in coating systems is conventionally referred to as pressing on. Optionally, it can be expedient to eject at least one drop or a defined amount of the new coating agent or its components through the nozzle.

The flushing device provided for the described flushing operations can be formed by at least one flushing medium line which leads parallel to the component supply lines into the application device and can optionally be connected or connectable via a mixer or directly to all the nozzles. If a colour changer is present, a flushing medium line can be connected, for example, to an inlet of the colour changer, so that the flushing medium can be fed to the nozzle print head through the supply line, for example, for the batch paint component. A flushing medium line which leads separately into the nozzle print head is also conceivable.

In advantageous examples of the disclosure, an external flushing device can further be provided in the coating system, for example a separate flushing apparatus arranged in the vicinity of the coating robot and reachable thereby. If a storage device for storing the nozzle print head during breaks in coating is provided in the coating system, the flushing apparatus can also be integrated into the storage device.

In any case, the flushing device should preferably be in such a form that the nozzle passages and also the outside surface of the nozzle print head, that is to say optionally the nozzle plate, can be flushed. Furthermore, back flushing of the nozzle plate or nozzle passages can be advantageous, wherein the flushing medium is pressed through the nozzle passage from the outside inwards, for example in order to clean a blocked nozzle. It is thus not necessary to change the nozzle print head or the nozzle plate, as would otherwise be required, and material and working time can thus be saved. For catching all the fluids that are ejected (from the nozzles) during flushing, that is to say coating composition and flushing medium and/or aerosols, the flushing apparatus can be provided with a corresponding collecting device, from which the fluids can then be separated and disposed of.

In general, the losses of coating composition and flushing medium should be as small as possible, and VOC emissions should be avoided. In the application methods described herein, paint or coating composition losses caused by a flushing operation should be limited to in any case less than 10 l, but preferably to less than 5 l, 200 ml, 20 ml, 10 ml, 5 ml or even 2 ml, and the flushing agent requirement should be limited to less than 10 l, but preferably less than 5 l, 2 l, 200 ml, 100 ml, 50 ml, 20 ml or even 10 ml.

In order to reduce the paint loss and the consumption of flushing medium during a colour change, it can also be sufficient in the processing of multicomponent paints to flush only the regions that come into contact with the colour-giving component, for example of a 2K base paint or 2K clear paint, and with the mixture of the two components.

It should be mentioned in this connection that, especially if the components are not mixed until they leave the nozzles or after they have left the nozzles, and already mixed coating material thus does not flow in the nozzle print head, losses of flushing medium and time which are otherwise required can be avoided, especially because special mixing elements then do not have to be flushed.

If mixing does not take place until the components leave the nozzle or after they have left the nozzle, this additionally has the advantage that desired mixing ratios can be established in a particularly simple manner and without problems.

Finally, it should also be mentioned that it has been discovered that the nozzle print heads known from the prior art, which are suitable only for one-component paint, can be adapted to the requirements for two-component coating compositions. In particular, the size, that is to say hydraulic cross-sections, of the nozzles and their passages are to be dimensioned according to the particular mixing ratio. Moreover, solvent-resistant materials should be used where possible, such as, for example, seals made of FFKM (that is to say perfluorinated rubber).

In the painting system according to the disclosure shown in FIG. 1 for the complete painting in series of motor vehicle bodies, the components to be painted are transported on a conveyor 1, at a right angle to the plane of the drawing, through a painting booth 2 in which the components are then painted by painting robots in a manner which is in part known per se. In the example shown, the painting robots 3, 4 have two pivotable robot arms and each guide an application device via a multi-axis robot hand axis. For example, the robots can be robots having six or more rotary axes and optionally a linear movement axis along the conveyor path. Painting robots having at least seven rotary axes have the advantage in the painting of bodies that the expense of a movement axis can in many cases be dispensed with.

In contrast to conventional painting systems with conventional rotary atomisers or other atomisers, the painting robots 3, 4 guide as the application device nozzle print heads 8, 9 for 2K or multicomponent paint. These nozzle print heads have a substantially greater application efficiency than atomisers of more than 95% to 99% and thus generate virtually no overspray. On the one hand, this has the advantage that it is possible to omit the washing out beneath the booth which is required in conventional painting systems with atomisers. Instead, in the painting system according to the disclosure there can be an extraction of air 10 beneath the painting booth 2 which, if required, draws the booth air downwards out of the booth through a filter cover 11 without the need for any other outlay for collecting and separating off overspray. In many cases, the extraction of air is also possible without a filter. This can also take place via passages arranged in the region of the bottom.

Figure 2:
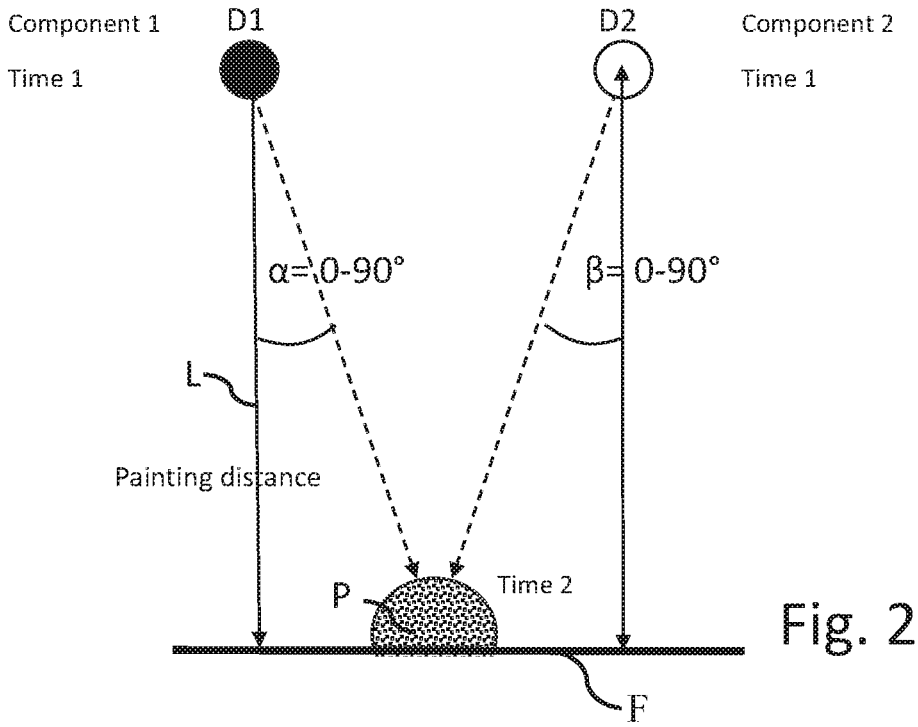
FIG. 2 is the schematic representation of components ejected from two nozzles according to an example of the disclosure.

FIG. 2 explains an example of the disclosure in which two components of the coating composition are not mixed together until they strike the surface to be coated, by the impact of the drops or jets. These drops or jets are generated by two nozzles D1 and D2, shown schematically, which are arranged side by side in a common plane of the nozzle print head, one nozzle ejecting a first component (e.g. batch paint) and the other nozzle ejecting a second component (curing agent). The components can be ejected in succession in time or also simultaneously at a time 1 and, corresponding to the painting distance L of the nozzles D1 and D2 from the surface F to be coated and the speeds of travel of the components, the two components strike the surface F slightly later at a time 2, namely at least approximately at the same point P, where they are mixed with one another.

In the example shown, according to the representation, ejection directions (shown by broken lines) of the two nozzles D1 and D2 are inclined relative to the painting distance L, which is perpendicular to the surface F, and towards the respective other nozzle by, for example, opposite equal angles of travel $\alpha$ and $\beta$. The size of the chosen angle of travel, as well as being dependent on the painting distance L, is obviously also dependent on the distance, measured parallel to the surface F, between the nozzles D1 and D2 and can be, for example, between approximately 0 and 90°. The speeds of travel and/or the angles of travel of the two components can also be different from one another. If the nozzles D1 and D2 are opened at different times, a translation movement of the nozzles relative to the surface F during the application of the two components can also be taken into consideration.

Figure 3:
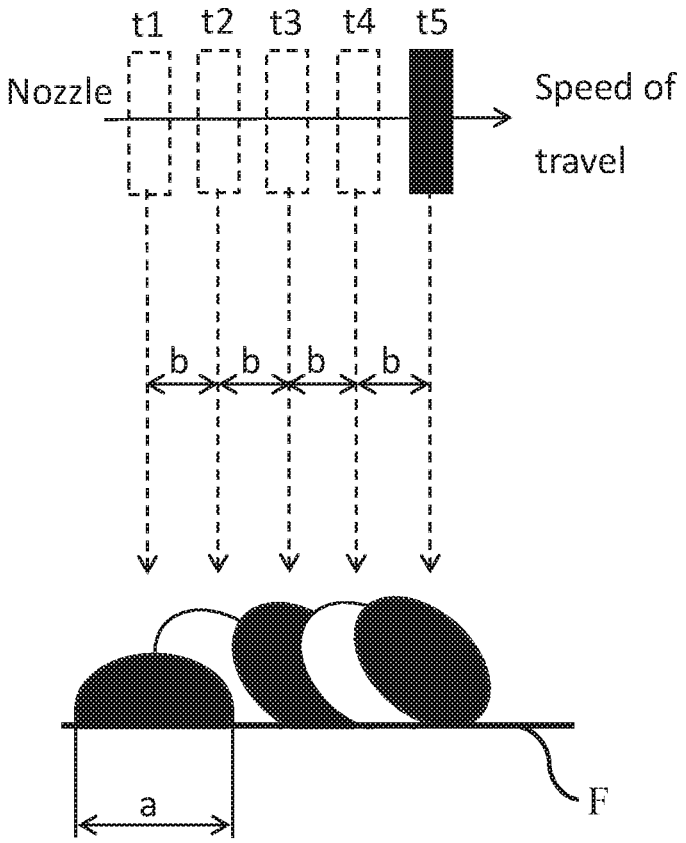
FIG. 3 is the schematic representation of the generation of mutually overlapping coating points.

FIG. 3 explains, schematically, the overlapping application of coating points to the surface F to be coated, there generally being applied drops of already mixed components which then in turn mix with one another on the surface F by flowing together. However, they could also be components which do not mix until they are on the surface F to be coated. While the nozzles are moved, for example, by the coating robot along the surface F with the specified speed of movement, they each generate a coating point, for example a drop, having a defined size a at predetermined successive, equally spaced times t1 to t5 etc. The respective nozzle is so controlled in terms of time that defined drop distances b along the surface F and consequently the desired overlapping of the applied drops are obtained. The degree of overlap can be between more than 0% and approximately 75% (triple overlap), that is to say approximately 10%, 20%, 30% or 50% (double overlap with b=½ a) or also b=⅓ a or ⅔ a. However, the coating points can instead be applied adjacent to one another, that is to say without an overlap (b=a).

In principle, such an application with or without an overlap is possible when the components are already mixed before or in the nozzle print head or after they have left the nozzle but before they reach the surface to be coated. An overlapping application is advantageous even if continuous jets are applied rather than individual drops.

Figure 4:
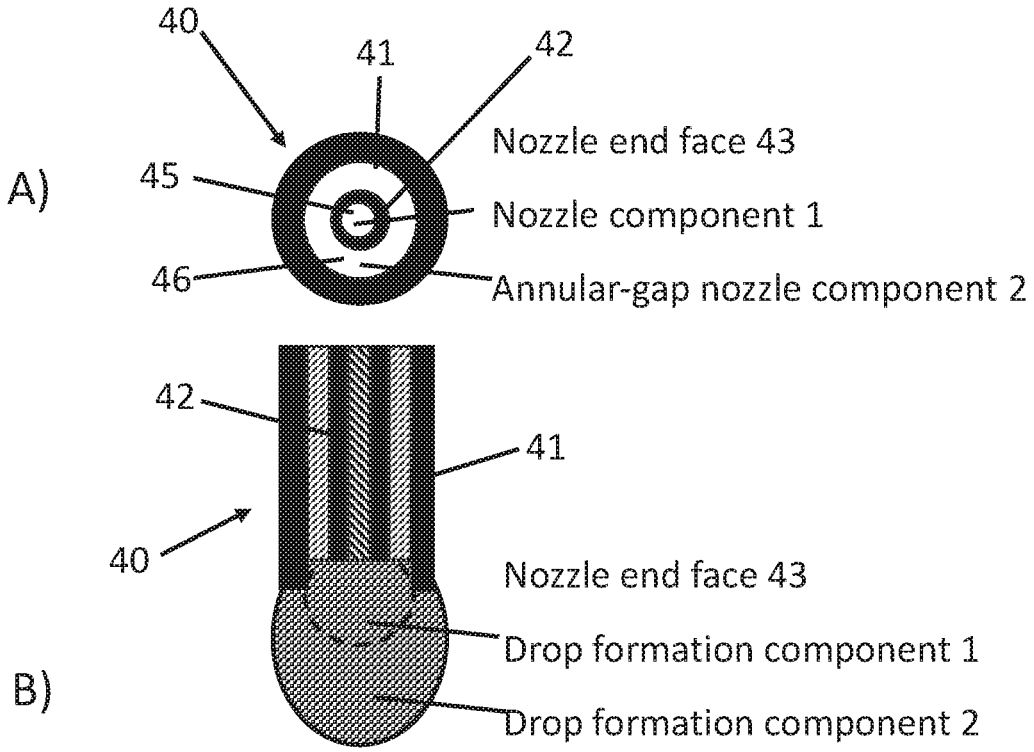
FIG. 4 shows a nozzle unit to be used in an example of the disclosure.

FIG. 4 shows, schematically, a nozzle unit 40 in the form of a twin nozzle for mixing two components of a coating composition (e.g. 2K paint) in or at the nozzle print head. The nozzle unit 40 consists substantially of an outer tubular body 41 in the interior, for example the cylindrical interior, of which an inner tube 42, which, for example, is likewise cylindrical, is arranged concentrically. While FIG. 4B) shows a longitudinal section through this tubular nozzle unit 40, FIG. 4A) is a plan view of the lower nozzle end face in FIG. 4B). The outer tubular body 41 can protrude outwards, according to the representation, at the nozzle end face 43 axially beyond the inner tube 42. One component of the coating composition (e.g. batch paint) is pressed through the inner tube 41 to the outlet 45, which in the example under consideration is circular, while the second component (e.g. curing agent) is pressed to the outlet 46 in the form of an annular gap between the inner tube 42 and the outer tubular body 41. Conversely, it would also be possible to guide the first-mentioned component through the annular gap and consequently the second component through the inner tube.

In the example in question here, mixing of the components takes place at the end face 43 of the twin nozzle or nozzle unit 40 shown, that is to say at the outlet thereof, where each of the drops formed there according to the representation mix with one another. It can be advantageous if the formation of the respective drops does not begin at the same time but the two nozzle elements, that is to say the inner tube 42 and the outlet 46 in the form of the annular-gap nozzle, are controlled in terms of time by valves (not shown)

so that the drop is formed at the inner tubular nozzle first and only then is the drop formed at the annular-gap nozzle. The reverse sequence can also be advantageous. However, simultaneous opening of the two nozzle elements is also conceivable instead.

As has been mentioned at the beginning, the nozzle print head according to the disclosure preferably holds a plurality of such nozzle units which in particular can be arranged in one or more rows.

While the disclosure in FIG. 4 explains a twin nozzle unit using the example of drop formation, such or similar twin nozzles are also conceivable for generating component jets which can be mixed at the nozzle outlets. In both cases, the two nozzle elements can be controlled in terms of their opening times jointly and/or each individually by associated controllable valves.

As has already been mentioned, it can be advantageous to provide the components to be mixed with a swirling motion. This can be achieved, for example, by means of a spiral groove on the inside of a nozzle passage (similar in principle to a rifled gun barrel).

The invention claimed is:

1. A method, comprising:

ejecting drops of a coating composition onto surfaces of motor vehicle bodies or add-on parts, the coating composition consisting of at least two components which are to be mixed together, the droplets ejected from a nozzle print head which contains a pair of nozzles arranged side by side which apply the coating composition to the surface to be coated as individual drops, the nozzle print head is arranged on a multi-axis coating robot which moves the nozzle print head over the surface to be coated, the two components supplied to the pair of nozzles by two supply lines, the drops of the components of the coating composition ejected from the pair of nozzles at different speeds of travel and at different times so that the drop that is ejected later meets the drop ejected first in mid-air and mixes therewith.

2. The method according to claim 1, characterised in that the pair of nozzles of the nozzle print head targetedly direct the drops of the coating composition or the components thereof at individual points of the surface to be coated, wherein the applied impact points in particular adjoin one another or overlap with one another.

3. The method according to claim 1, characterised in that the coating composition is (a) a liquid multicomponent paint, (b) a primer, (c) an adhesive or sealant or (d) a preserving agent, and in each case has at least one batch component and at least one curing agent component that reacts therewith.

4. The method according to claim 1, characterised in that there is provided at least one colour changer which (a) is connected to at least one of the supply lines of the application device or of the nozzle print head and supplies selectable paint components of different colours to the at least one supply line in a controlled manner, and (b) is arranged on a painting robot which moves the nozzle print head relative to the surface to be coated, or (c) is fixedly arranged in a painting booth.

5. The method according to claim 1, characterised in that the pair of nozzles each contain at least two passages which lead to a nozzle outlet.

6. The method according to claim 1, further comprising imparting a swirling motion to the ejected components by constructive shaping of the pair of nozzles or the supply channels thereof, for the purpose of better mixing.

7. The method according to claim 1, characterised in that the pair of nozzles of the nozzle print head are controllable in respect of their respective opening and closing times by program control signals for actuating valves of the nozzles.

8. The method according to claim 1, characterised in that longitudinal axes of the pair of nozzles of the nozzle print head, with respect to a plane of a nozzle plate of the nozzle print head, (a) extend perpendicularly to the plane, or (b) extend at an angle to the plane, in particular at different, equal or opposite equal angles of adjacent nozzles.

9. The method according to claim 1, characterised in that the nozzle print head includes a nozzle plate which contains, in a plate plane, openings serving as the pair of nozzles, the openings arranged in one or more parallel rows.

10. The method according to claim 1, characterised in that there is provided a flushing device for the nozzle print head, which (a) is formed by at least one flushing medium line which leads into the application device or into the nozzle print head and to which the pair of nozzles are connected, or (b) is formed by an apparatus arranged externally in a coating system in the vicinity of a multi-axis robot which moves the nozzle print head.

11. The method according to claim 10, characterised in that the flushing apparatus (a) is configured for flushing nozzle passages of the pair of nozzles, or (b) for flushing an outside surface of the nozzle print head or a nozzle plate containing the nozzles, (c) has a collecting device for collecting coating composition or flushing medium ejected from the pair of nozzles during flushing.

12. The method according to claim 5, characterised in that the at least two passages extend concentrically to one another.

13. The method according to claim 12, characterised in that the at least two passages are formed by one annular gap and a central opening.

* * * * *